United States Patent [19]

Yu et al.

[11] Patent Number: 4,654,284

[45] Date of Patent: Mar. 31, 1987

[54] ELECTROSTATOGRAPHIC IMAGING MEMBER WITH ANTI-CURL LAYER COMPRISING A REACTION PRODUCT OF A BINDER BI-FUNCTIONAL COUPLING AGENT AND CRYSTALLINE PARTICLES

[75] Inventors: Robert C. U. Yu, Webster; Anthony M. Horgan, Pittsford; Francis J. Wieloch, Penfield, all of N.Y.

[73] Assignee: Xerox Corporation, Stamford, Conn.

[21] Appl. No.: 790,929

[22] Filed: Oct. 24, 1985

[51] Int. Cl.[4] ..... G03G 5/10

[52] U.S. Cl. ..... 430/59; 430/531; 430/930

[58] Field of Search ..... 430/141, 533, 56, 59, 430/930, 531

[56] References Cited

U.S. PATENT DOCUMENTS

| | | | |
|---|---|---|---|
| 3,861,942 | 1/1975 | Guestaux | 430/533 |
| 4,141,735 | 2/1979 | Schrader et al. | 430/191 |
| 4,209,584 | 6/1980 | Joseph | 430/527 |

FOREIGN PATENT DOCUMENTS 794658 5/1958 United Kingdom .

*Primary Examiner*—John L. Goodrow
*Attorney, Agent, or Firm*—Peter H. Kondo

[57] ABSTRACT

An imaging member comprising at least one flexible electrophotographic imaging layer, a flexible supporting substrate layer having an electrically conductive surface and an anti-curl layer, the anti-curl layer comprising a film forming binder, crystalline particles dispersed in the film forming binder and a reaction product of a bi-functional chemical coupling agent with both the film forming binder and the crystalline particles. This imaging member may be employed in an electrostatographic imaging process.

15 Claims, No Drawings

ELECTROSTATOGRAPHIC IMAGING MEMBER WITH ANTI-CURL LAYER COMPRISING A REACTION PRODUCT OF A BINDER BI-FUNCTIONAL COUPLING AGENT AND CRYSTALLINE PARTICLES

BACKGROUND OF THE INVENTION

This invention relates in general to electrostatography and, more specifically, to a flexible electrophotoconductive imaging member having an anti-curl backing layer.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. Nos. 4,265,990 and 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member tends to curl. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. Coatings may be applied to the side of the supporting substrate opposite the photoconductive layer to counteract the tendency to curl. However, difficulties have been encountered with these anti-curl coatings. For example, photoreceptor curl can sometimes still be encountered in as few as 1,500 imaging cycles under the stressful conditions of high temperature and high humidity. Further, it has been found that during cycling of the photoconductive imaging member in electrophotographic imaging systems, the relatively rapid wearing away of the anti-curl coating also results in the curling of the photoconductive imaging member. In some tests, the anti-curl coating was completely removed in 150 thousand to 200 thousand cycles. This erosion problem is even more pronounced when photoconductive imaging members in the form of webs or belts are supported in part by stationary guide surfaces which causes the anti-curl layer to wears away very rapidly and produce debris which scatters and deposits on critical machine components such as lenses, corona charging devices and the like, thereby adversely affecting machine performance. Also, the anti-curl coatings occasionally separate from the substrate during extended cycling and render the photoconductive imaging member unacceptable for forming quality images. It has also been found that when long webs of a flexible photoconductor having an anti-curl coating on one side of a supporting substrate and a photoconductive layer on the opposite side of the substrate are rolled into large rolls, dimples and creases form on the photoconductive layer which result in print defects in the final developed images. Further, when the webs are formed into belts, segments of the outer surface of the anti-curl belt in contact with each other during shipment or storage at elevated temperatures also cause creases and dimples to form which are seen as undesirable aberrations in the final printed images. Expensive and elaborate packaging is necessary to prevent the anti-curl coating from contacting itself.

Further, difficulties have been encountered in continuous coating machines during the during winter manufacturing of the coated photoconductive imaging members because of occasional seizing which prevents transport of the coated web through the machine for downstream processing.

Anti-curl layers will also occasionally delaminate due to poor adhesion to the supporting substrate. Moreover, in electrostatographic imaging systems where transparency of the substrate and anti-curl layer are necessary for rear exposure to activating electromagnetic radiation, any reduction of transparency due to opacity of the supporting substrate or anti-curl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

Thus, the characteristics of electrostatographic imaging members comprising a supporting substrate coated on one side with at least one photoconductive layer and coated on the other side with an anti-curl layer exhibit deficiencies which are undesirable in automatic, cyclic electrostatographic copiers, duplicators, and printers.

SUMMARY OF THE INVENTION

It is an object of the invention to provide an electrophotographic imaging member which overcomes the above-noted disadvantages.

It is an another object of this invention to provide an electrophotographic imaging member with improved resistance to formation of dimples and creases.

It is another object of this invention to provide an electrophotographic imaging member having an anti-curl layer which is substantially transparent to electromagnetic radiation which activates the photogenerating layer.

It is still another object of this invention to provide an electrophotographic imaging member which resists abrasion.

It is another object of this invention to provide an electrophotographic imaging member which may readily be conveyed in continuous web coating apparatus.

It is still another object of this invention to provide an electrophotographic imaging member having an anti-curl layer with improved adhesion to a supporting substrate.

SUMMARY OF THE INVENTION

The foregoing objects and others are accomplished in accordance with this invention by providing an imaging member comprising at least one flexible electrophotographic imaging layer, a flexible supporting substrate layer having an electrically conductive surface and an anti-curl layer, the anti-curl layer comprising a film forming binder, crystalline particles dispersed in the film forming binder and a reaction product of a bifunctional chemical coupling agent with both the film forming binder and the crystalline particles.

The flexible supporting substrate layer having an electrically conductive surface may comprise any suitable flexible web or sheet. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient internal strength to support the electrophotoconductive layer and anti-curl layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, carbon black, graphite and the like. The flexible conductive layer may vary in thickness over substantially wide ranges depending on the desired use of the electrophotoconductive member. Accordingly, the conductive layer can generally range in thicknesses of from about 50 Angstrom units to many centimeters. When a highly flexible photoresponsive imaging device is desired, the thickness of the conductive layer may be between about 100 Angstrom units to about 750 Angstrom units. Any underlying flexible support layer may be of any conventional material including metal, plastics and the like. Typical underlying flexible support layers include insulating non-conducting materials comprising various resins known for this purpose including polyesters, polycarbonates, polyamides, polyurethanes, and the like. The coated or uncoated flexible supporting substrate layer is normally flexible and may have any number of different configurations such as, for example, a sheet, a cylinder, a scroll, an endless flexible belt, and the like. Preferably, the insulating web is in the form of an endless flexible belt and comprises a commercially available polyethylene terephthalate polyester known as Mylar available from E. I. du Pont de Nemours & Co.

If desired, any suitable charge blocking layer may be interposed between the conductive layer and the electrophotographic imaging layer. Some materials can form a layer which functions as both an adhesive layer and charge blocking layer. Any suitable blocking layer material capable of trapping charge carriers may be utilized. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability is extended. The entire disclosure of U.S. Pat. No. 4,464,450 is incorporated herein by reference. The specific silanes employed to form the preferred blocking layer are identical to the preferred silanes employed to treat the crystalline particles of this invention. In other words, silanes having the following structural formula:

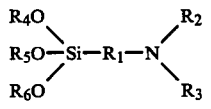

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers. The pH of the solution of hydrolyzed silane is carefully controlled to obtain optimum electrical stability. A solution pH between about 4 and about 10 is preferred. Optimum blocking layers are achieved with hydrolyzed silane solutions having a pH between about 7 and about 8, because inhibition of cycling-up and cycling-down characteristics of the resulting treated photoreceptor maximized. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

Any suitable technique may be utilized to apply the hydrolyzed silane solution to the conductive layer. Typical application techniques include spraying, dip coating, roll coating, wire wound rod coating, and the like. Generally, satisfactory results may be achieved when the reaction product of the hydrolyzed silane forms a blocking layer having a thickness between about 20 Angstroms and about 2,000 Angstroms.

A preferred blocking layer comprises a reaction between a hydrolyzed silane and a metal oxide layer of the electrically conductive layer, the hydrolyzed silane having the general formula:

I.

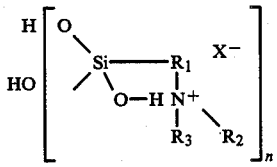

-continued

II.

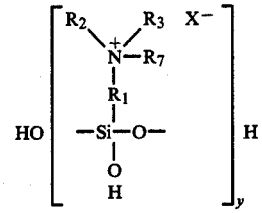

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt or tree base of these salts, n is 1, 2, 3 or 4, and y is 1, 2, 3 or 4. The imaging member is prepared by depositing on the metal oxide layer of the conductive layer a coating of an aqueous solution of the hydrolyzed silane at a pH between about 4 and about 10, drying the reaction product layer to form a siloxane film and applying the generating layer and charge transport layer to the siloxane film.

The hydrolyzed silane may be prepared by hydrolyzing a silane having the following structural formula:

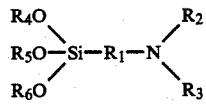

wherein $R_1$ is an alkylidene group containing 1 to 20 carbon atoms, $R_2$ and $R_3$ are independently selected from H, a lower alkyl group containing 1 to 3 carbon atoms, a phenyl group and a poly(ethylene)-amino or ethylene diamine group, and $R_4$, $R_5$ and $R_6$ are independently selected from a lower alkyl group containing 1 to 4 carbon atoms. Typical hydrolyzable silanes include 3-aminopropyl triethoxy silane, (N,N'-dimethyl 3-amino)propyl triethoxysilane, N,N-dimethylamino phenyl triethoxy silane, N-phenyl aminopropyl trimethoxy silane, trimethoxy silylpropyldiethylene triamine and mixtures thereof.

If $R_1$ is extended into a long chain, the compound becomes less stable. Silanes in which R1 contains about 3 to about 6 carbon atoms are preferred because the molecule is more stable, is more flexible and is under less strain. Optimum results are achieved when $R_1$ contains 3 carbon atoms. Satisfactory results are achieved when $R_2$ and $R_3$ are alkyl groups. Optimum smooth and uniform films are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate general structure:

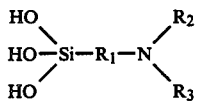

After drying, the siloxane reaction product film formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 5 percent by weight of the silane based on the total weight of the solution. A solution containing from about 0.05 percent by weight to about 0.2 percent by weight silane based on the total weight of solution are preferred for stable solutions which form uniform reaction product layers. It is critical that the pH of the solution of hydrolyzed silane be carefully controlled to obtain optimum electrical stability. A solution pH between about 4 and about 10 is preferred. Thick reaction product layers are difficult to form at solution pH greater than about 10. Moreover, the reaction product film flexibility is also adversely affected when utilizing solutions having a pH greater than about 10. Further, hydrolyzed silane solutions having a pH greater than about 10 or less than about 4 tend to severely corrode metallic conductive anode layers such as those containing aluminum during storage of finished photoreceptor products. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulfonic acid and the like.

If desired, the aqueous solution of hydrolyzed silane may also contain additives such as polar solvents other than water to promote improved wetting of the metal oxide layer of metallic conductive anode layers. Improved wetting ensures greater uniformity of reaction between the hydrolyzed silane and the metal oxide layer. Any suitable polar solvent additive may be employed. Typical polar solvents include methanol, ethanol, isopropanol, tetrahydrofuran, methylcellosolve, ethylcellosolve, ethoxyethanol, ethylacetate, ethylformate and mixtures thereof. Optimum wetting is achieved with ethanol as the polar solvent additive. Generally, the amount of polar solvent added to the hydrolyzed silane solution is less than about 95 percent based on the total weight of the solution.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle prior to the point where increases in residual charges become unacceptable. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Generally, increasing the reaction time increases the degree of cross-linking of the hydrolyzed silane. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at subatmospheric pressures.

One may readily determine whether sufficient condensation and cross-linking has occurred to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si—O— wavelength bands between about 1,000 to about 1,200 cm-1. If the Si—O— wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450, issued Aug. 7, 1984 to Leon A. Teuscher, the disclosure of this patent being incorporated herein in its entirety.

In some cases, intermediate layers between the blocking layer and the adjacent charge generating or photogenerating material may be desired to improve adhesion or to act as an electrical barrier layer. If such layers are utilized, they preferably have a dry thickness between about 0.01 micrometer to about 5 micrometers. Typical adhesive layers include film-forming polymers such as polyester, polyvinylbutyral, polyvinylpyrolidone, polyurethane, polymethyl methacrylate and the like.

Generally, the electrophotoconductive imaging member of this invention comprises an anti-curl layer, a supporting substrate layer and an electrophotographic imaging layer. The electrophotographic imaging layer may comprise a single layer or multilayers. The layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound is dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, U.S. Pat. No. 4,507,480, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent orgainic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

Polymers having this characteristic, e.g. capability of transporting holes, have been found to contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferrred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

The charge transport layer forming mixture preferably comprises an aromatic amine compound of one or more compounds having the general formula:

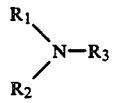

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free from electron withdrawing groups such as $NO_2$ groups, CN groups, and the like. Typical aromatic amine compounds that are represented by this structural formula include:

I. Triphenylamines such as:

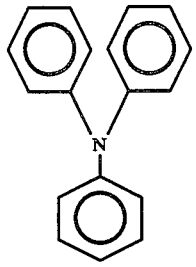

II. Bis and polytriarylamines such as:

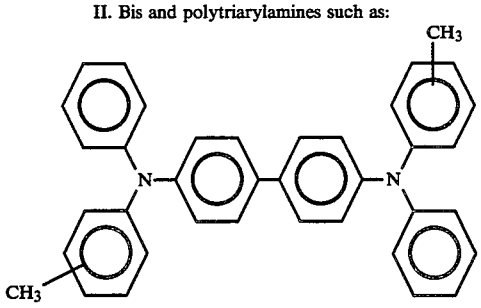

III. Bis arylamine ethers such as:

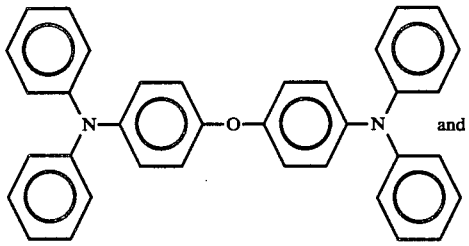

IV. Bis alkyl-arylamines such as:

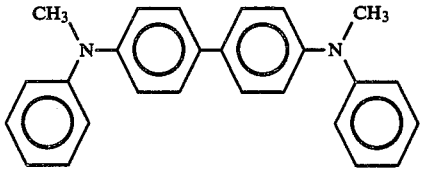

A preferred aromatic amine compound has the general formula:

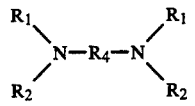

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members doped in accordance with this invention comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

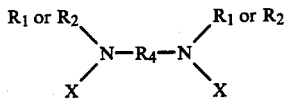

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A.G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Alternatively, as previously mentioned, the active layer may comprise a photogenerated electron transport material, for example, trinitrofluorenone, poly-N-vinyl carbazole/trinitrofluorenone in a 1:1 mole ratio, and the like.

In all of the above charge transport layers, the activating compound which renders the electrically inactive polymeric material electrically active should be present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Although it is preferred that the acid doped methylene chloride be prepared prior to application to the charge generating layer, one may instead add the acid to the aromatic amine, to the resin binder or to any combination of the transport layer components prior to coating. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition is about 8.5 percent by weight charge transporting aromatic amine, about 8.5 percent by weight polymeric binder, and about 83 percent by weight methylene chloride. The methylene chloride can contain from about 0.1 ppm to about 1,000 ppm protonic or Lewis acid based on the of weight methylene chloride.

Optionally, an overcoat layer may also be utilized to improve resistance to abrasion. These overcoating layers may comprise organic polymers or inorganic polymers that are electrically insulating or slightly semi-conductive.

Any suitable film forming binder may be utilized in the anti-curl layer. The film forming binder should be a flexible thermoplastic resin having reactive groups which will react with reactive groups on the coupling agent molecule. Typical thermoplastic resins include polycarbonates, polyesters, polyurethanes, acrylate polymers, vinyl polymers, cellulose polymers, polysiloxanes, polyamides, polyurethanes, epoxies, nylon, polybutadiene, natural rubber, and the like. The thermoplastic resins should have $T_g$ of at least about 40° C. to achieve a coated film having good beam strength, flexural strength, and nontackiness. The thermoplastic resins should contain reactive groups which will react with reactive groups on the coupling agent molecule. Typical reactive groups in resins include COOH, OH, vinyl, amino, amide, epoxide, carbonyl, and the like. Typical thermoplastic resins containing reactive groups include polycarbonates, polyesters, polyurethanes, acrylate polymers, cellulose polymers, polyamides, nylon, polybutadiene, poly(vinyl chloride), polyisobutylene, polyethylene, polypropylene, polyterephthalate, polystyrene, styrene-acrylonitrile copolymer, and the like and mixtures thereof. The thermoplastic resins preferably contain reactive groups selected from the group consisting of COOH and OH groups. Specific examples of resins having reactive groups that will react with bi-functional coupling agents include polycarbonate resin containing OH reactive groups such as Lexan from General Electric Co. and Merlon from Mobay Chemical Co., cellulose resins containing OH and COOH reactive groups, polyester resins containing COOH or OH reactive groups, and the like and mixtures thereof. A film forming binder of polycarbonate resin is particularly preferred because of its excellent adhesion to adjacent layers and transparency to activating radiation.

Any suitable crystalline particle having reactive hydroxyl groups chemically attached to metal or metalloid atoms located on the outer surface of the particles may be employed. The expression "crystalline" is defined as an inorganic material having a regular shape determined by an orderly three-dimensional atomic lattice work. Typical metal and metalloid atoms include silicon, titanium, zirconium, aluminum, and the like. The crystalline particles may have any suitable outer shape. Typical outer shapes include irregular, granular, elliptical, cubic, flake, and the like. The crystalline particles should have a hardness greater than about 2.5 Mohs for satisfactory improvement in wear resistance against mechanical contact with materials such as glass, metals, composites, and the like. A hardness greater than about 4.5 Mohs is preferred for optimum operating longevity. Typical crystalline particles include euhedral quartz crystal, sandstone, quartzite sand, quartz rock, novaculite, silicon dioxide, aluminum oxide, titanium dioxide, and the like. Preferably, the crystalline particles should have a particle size less than the thickness of the anti-curl layer to avoid an anti-curl layer having an irregular outer surface. An average crystalline particle size between about 0.3 micrometer and about 5 micrometers is preferred because protrusion of the particles through the outer surface of the anti-curl layer is minimized or eliminated with particles less than about 5 micrometers and inter particle agglomeration is minimized with a particle size greater than about 0.3 micrometer. For optimum transparency, the treated crystalline particles should have a refractive index within about 0.5 of that of the hardened film forming binder.

Generally, the anti-curl layer comprises from about 0.1 percent by weight to about 30 percent by weight of crystalline particles, based on the total weight of the anti-curl layer. A concentration of crystalline particles greater than about 30 percent by weight renders the anti-curl coating more difficult to apply, makes the transport layer more susceptible to scratches caused by contact with the anti-curl layer during rolling and unrolling, and causes the anti-curl coating to be less stable as a dispersion. At a loading exceeding about 20 percent by weight optical clarity begins to fall off When less than about 5 percent by weight of the crystalline particles are utilized, the improvement in wear resistance is relatively slight but some improvement in transport the web through coating machinery is achieved even with crystalline silica particle concentrations as low as 0.1 percent by weight. Thus, about between 5 percent by weight to about 20 percent by weight of crystalline particles, based on the total weight of the anti-curl layer is preferred.

Any suitable bi-functional chemical coupling agent may be employed to treat the surface of the crystalline particles. The bi-functional chemical coupling agent comprises in a single molecule at least one reactive group which will react with hydroxyl groups on the surface of the crystalline particles and at least one organo functional reactive group which will react with reactive groups on the film forming binder molecules. Selection of the organo functional reactive group for the bi-functional coupling agent molecule depends on the reactive groups present on the film forming resin molecule to employed. Typical reactive groups on the bi-functional chemical coupling agent that react with reactive groups on thermoplastic resins include vinyl, amino, azido, amino, epoxide, halogen, sulfite, and the like. Thus, the crystalline particles and bi-functional coupling agent are chemically bonded to each other through an oxygen atom and the bi-functional coupling agent and film forming binder are also chemically bonded to each other. Typical reactive groups on bi-functional coupling agents which will react with the hydroxy groups on the surface of the crystalline particles include alkoxy, acetoxy, hydroxy, carboxy and the like. The hydrolyzable groups on the coupling agents react directly, chemically attaching themselves to the particles. For example, for crystalline silica particles, the hydrolyzable ends of the bi-functional silane coupling agents attach to the hydroxyl groups on the outer surface of the crystalline particles via silanols (SiOH) groups formed through hydrolysis of the hydrolyzable groups. Typical bi-functional chemical coupling agents include organosilanes having these characteristics include amino silanes such as 3-aminopropyl triethoxy silane, (N,N'-dimethyl 3-amino)propyl triethoxysilane, N,N-dimethylamino phenyl triethoxy silane, N-phenyl aminopropyl trimethoxy silane, trimethoxy silylpropyldiethylene triamine, N-aminoethyl-3-aminopropyltrimethoxysilane, N-(2-aminoethyl)-3-aminopropyltrimethoxysilane, N-2-aminoethyl-3-aminopropyltris(ethylhethoxy)silane, p-aminophenyl trimethoxysilane, 3-aminopropyldiethylmethylsilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, and 3[2(vinyl benzylamino)ethylamino]propyltrimethoxy silane; halo silanes such as chloropropyltriethoxysilane and (3-chloropropyl)trimethoxy silane; vinyl silanes such as vinyl triethoxy silane, triacetoxyvinyl silane, tris(2-methoxyethoxy)vinyl silane and 3-methacryloxypropyltrimethoxy silane; epoxy silanes such as [2-(3,4-epoxycyclohexylethyltrimthoxy silane; mercaptosilanes such as azido compounds such as AXCMP MC azido silane and azidotrimethoxy silane; organotitanates, such as neoalkoxy, tri(dioctylphosphato titanate), neoalkoxy, tri(N ethylaminoethylamino)titanate, neoalkoxy, tri(m-amino)phenyl titanate and isopropyl di(4amino benzoyl-)isostearoyl titanate; organozirconates such as neoalkoxy trisneodecanoyl zirconate, neoalkoxy tris(dioctyl)-phosphato zirconate, neoalkoxy tris(dioctyl)pyrphosphata zirconate, neoalkoxy tris(ethylene diamino)ethyl zirconate, neoalkoxy tris(m-amino)phenyl zirconate; and the like and mixtures thereof.

These coupling agents are usually applied to the crystalline particles prior to dispersion of the crystalline particles into the film forming binder. Any suitable technique may be utilized to apply and react the coupling agent with the surface of the crystalline particles. The deposited coupling agent coating on the crystalline particles are continuous, thin, and preferably in the form of a monolayer. A preferred process for applying the bi-functional chemical coupling agent to the crystalline particles is by stirring the crystalline particles in an aqueous solution of a hydrolyzed silane. After thoroughly wetting the surface of the crystalline particles with the aqueous solution to ensure reaction between the reactive groups on the coupling agent molecule and the hydroxyl groups on the outer surface of the crystalline particles, the treated crystalline particles may be separated from the aqueous solution by any suitable technique such as filtering. The treated crystalline particles may thereafter be dried by conventional means such as oven drying, forced air drying, combinations of vacuum and heat drying, and the like. Other techniques of silylation such as contacting the outer surface of the crystalline particles with vapors or sprays of the bifunctional coupling agent.may also be employed. For example, sylylation may be accomplished by pouring or spraying the bi-functional chemical coupling onto the crystalline particles while the crystalline particles are agitated in a high intensity mixer at an elevated temperature. In this blending technique, the coupling agent is reacted with the hydroxyl groups directly attached to metal or metalloid atoms at the surface of the crystalline particles to form a reaction product in which the crystalline particles and the bi-functional coupliing agent are chemically bonded to each other through an oxygen atom. Such a process is described, for example, in U.S. Pat. No. 3,915,735, the disclosure of which is incorporated herein by reference in its entirety.

Generally, the concentration of the bi-functional coupling agent in the treating solution should be sufficient to provide at least a continuous mono molecular layer of coupling agent on the surface of the crystalline particles. Satisfactory results may be obtained with an aqueous solution containing from about 1 percent by weight to about 5 percent by weight of coupling agent based on the weight of the solution. After drying, the crystalline particles coated with the reaction product of the bi-functional coupling agent and hydroxyl groups attached to the metal or metalloid atoms on the outer surface of the crystalline particles are dispersed in the film forming binder where further reaction occurs between the reactive organo functional groups of the bi-functional coupling agent and reactive groups on the film forming binder molecules. Dispersion may be effected by any suitable conventional mixing technique such as blending the treated silica particles with a molten thermoplastic resin or in a solution of the resin in a solvent.

Typical combinations of bi-functional chemical coupling agents and film forming binder polymers having reactive groups include 3-aminopropyl triethoxy silane and polycarbonate; tris(2-methoxyethoxy)vinyl silane and polyethylene; 4-aminopropyl triethoxy silane and nylon; [3-(2-aminoethylamino)propyl]trimethoxy silane and nylon; 3-methacryloxypropyltrimethoxy silane and polyester; (3-glycidoxypropyl)trimethoxy silane and polycarbonate; 4-aminopropyl triethoxy silane and poly(vinylchloride); vinyltris(2-methoxyethoxy)silane and polystyrene; and the like.

Aminosilane bi-functional chemical coupling agents are preferred because the amine functionality forms an excellent chemical bond through its reaction with COOH and OH groups of film forming binder polymers and excellent chemical bonding through an oxygen atom to the crystalline particles. These silanes are applied in hydrolyzed form because the OH groups of the silane will readily condense with the silanol groups on the crystalline particle surfaces and position the organofunctional amine group of the silane for reaction with the reactive group on the film forming binder polymer.

The preferred hydrolyzed silane has the general formula:

I

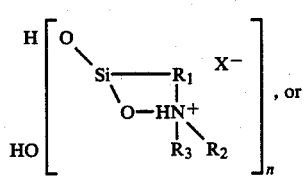

, or

II

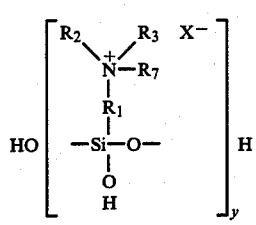

or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, and y is 1, 2, 3 or 4.

The hydrolyzed silane may be prepared by hydrolyzing an aminosilane having the following structural formula:

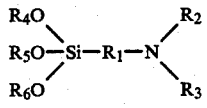

wherein R1 is an alkylidene group containing 1 to 20 carbon atoms, $R_2$ and $R_3$ are independently selected from the group consisting of H, a lower alkyl group containing 1 to 3 carbon atoms, a phenyl group and a poly(ethylene-amino) group, and $R_4$, $R_5$, and $R_6$ are independently selected from a lower alkyl group containing 1 to 4 carbon atoms. Typical hydrolyzable aminosilanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)-propyltriethoxysilane, or mixtures thereof because the hydrolyzed solutions of these materials exhibit a greater degree of basicity and stability and because these materials are readily available commercially.

If $R_1$ is extended into a long chain, the compound becomes less stable. Silanes in which $R_1$ contains about 3 to about 6 carbon atoms are preferred because the oligomer is more stable. Optimum results are achieved when $R_1$ contains 3 carbon atoms. Satisfactory results are achieved when $R_2$ and $R_3$ are alkyl groups. Optimum stable solutions are formed with hydrolyzed silanes in which $R_2$ and $R_3$ are hydrogen. Satisfactory hydrolysis of the silane may be effected when $R_4$, $R_5$ and $R_6$ are alkyl groups containing 1 to 4 carbon atoms. When the alkyl groups exceed 4 carbon atoms, hydrolysis becomes impractically slow. However, hydrolysis of silanes with alkyl groups containing 2 carbon atoms are preferred for best results.

During hydrolysis of the amino silanes described above, the alkoxy groups are replaced with hydroxyl groups. As hydrolysis continues, the hydrolyzed silane takes on the following intermediate structure:

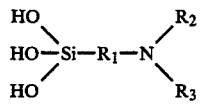

After drying, the reaction product layer formed from the hydrolyzed silane contains larger molecules in which n is equal to or greater than 6. The reaction product of the hydrolyzed silane may be linear, partially crosslinked, a dimer, a trimer, and the like.

The hydrolyzed silane solution utilized to treat the crystalline particles may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the crystalline particles. The thickness of the reaction product layer is estimated to be between about 20 Angstroms and about 2,000 Angstroms.

A solution pH between about 4 and about 14 may be employed. Optimum reaction product layers on the crystalline particles are achieved with hydrolyzed silane solutions having a pH between about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

If desired, the aqueous solution of hydrolyzed silane may also contain additives such as polar solvents other than water to promote the silylation process of involving the crystalline particles. Any suitable polar solvent other than water may be employed. Typical polar solvents include methanol, ethanol, isopropanol, tetrahydrofuran, methoxyethanol, ethoxyethanol, ethylacetate, ethylformate and mixtures thereof.

Any suitable technique may be utilized to treat the crystalline particles with the reaction product of the hydrolyzed silane. For example, washed crystalline silica can be swirled in a hydrolyzed silane solution for between about 1 minute and about 60 minutes and then the solids thereafter allowed to settle out and remain in contact with the hydrolyzed silane for between about 1 minute and about 60 minutes. The supernatent liquid may then be decanted and the treated crystalline silica filtered with filter paper. The crystalline silica may be dried at between about 1 minute and about 60 minutes at between about 80° C. and about 165° C. in a forced air oven for between about 1 minute and about 60 minutes. If desired, hydrolysis of the silane may be effected at the surface of the crystalline particles as described, for example, in Example 2 of U.S. Pat. No. 3,915,735.

Crystalline particles treated with bi-functional silane coupling agents are also commercially available. For example, crystalline silica particles reacted with an amino silane are available as SSO212 from Petrarch Systems, Inc. and crystalline silica particles reacted with 3-chloropropyltrimethoxy silane are available as SSO214 from Petrarch Systems, Inc.

Any suitable conventional coating technique may be utilized to apply the anti-curl layer to the supporting substrate layer. Typical coating techniques include solvent coating, extrusion coating, spray coating, lamination, dip coating, solution spin coating and the like. The deposited anti-curl layer may be dried by any conventional drying technique such as oven drying, forced air drying, circulating air oven drying, radiant heat drying, and the like.

The thickness of the anti-curl layer should be sufficient to substantially balance the total forces of the layer or layers on the opposite side of the supporting substrate layer substrate. The total forces are substantially balanced when the electrophotographic imaging member has no noticeable tendency to curl after all layers are dried. For example, for an electrophotographic imaging member in which the bulk of the coating thickness on the photoreceptor side of the imaging member was a transport layer containing predominantly polycarbonate resin and having a thickness of about 24 micrometers, on a Mylar substrate having a thickness of about 76 micrometers, sufficient balance of forces were achieved with a 13.5 micrometers thick anti-curl layer containing 99 percent by weight polycarbonate resin, 1 percent by weight polyester, and between about 5 and about 20 percent by weight of the bi-functional coupling agent treated crystalline particles of this invention, all weights being based on the total weight of the dried anti-curl layer. Similar results were obtained when the transport layer had a thickness of about 31 micrometers and the anti-curl layer on the other side of a Mylar film had a thickness of about 17 micrometers.

Excellent results are obtained when the anti-curl coating mixture contains a crystalline particle concentration of between about 0.9 percent by weight and about 0.45 percent by weight crystalline particles based on the total weight of the coating mixture and a solvent for the resin which has a high vapor pressure. When this coating mixture is applied to the supporting substrate, the solvent evaporates rapidly from the thin film and immobilizes the crystalline particles in the polymer matrix to form a layer in which the crystalline particles are homogeneously dispersed throughout the thickness of the film. This is particularly desirable for a uniform rate of wear during the life of the electrophotographic imaging member and to achieve high transparency characteristics in the anti-curl layer. The resulting contents of the crystalline particles in the dry anti-curl coating range between 20 percent by weight and about 5 percent by weight based on the total weight of the dry layer. At a loading exceeding about 20 percent by weight optical clarity begins to fall off and at loadings of less than about 5 percent by weight silica resistance to wear becomes relatively slight.

Surprisingly, the use of the bi-functional coupling agent treated crystalline particles of this invention provide significantly superior results in anti-curl layers compared to anti-curl layers without the treated crystalline particles or anti-curl layers with untreated crystalline particles. Moreover, the use of the bi-functional coupling agent treated crystalline particles such as aminosilane treated crystalline silica provide markedly better results than amorphous particles such as amorphous silica. For example, bi-functional coupling agent treated silica particles improved adhesion of the anti-curl layer to a supporting substrate layer by a factor more than 2 compared to amorphous silica particles such as Cabosil, Sylox Tx, Lovel #27, and Aerosil R972. Also surprising is the fact that optical transmission is maintained through the anti-curl layer even after the addition of crystalline treated silica thereby allowing erasure of electrostatic latent images through the back of the electrophotographic imaging member during electrophotographic cycling. Moreover, the resistance to curling during the cycling when an anti-curl coating containing 10 percent by weight of the bi-functional coupling agent treated crystalline silica particles of this invention was about 10 times greater than that provided by an anti-curl coating that was free of treated crystalline silica particles. In one test, the anti-curl coating of this invention reduced wear from 10 micrometers to only 1 micrometer after 330,000 wear cycles. This is particularly significant since the total original coating thickness was only 13.5 micrometers. Moreover, anti-curl coatings of this invention reduced the formation of machine dirt. Also, the bi-functional coupling agent treated crystalline silica particles of this invention improved adhesion of the anti-curl coatings to a polyester substrate by a factor of more than 2X. Further, the reduced coefficient of friction values for the improved photoreceptor prevents slowing down of the production line due to jamming problems and permits the use of rolls of photoreceptors that will not otherwise run in belt making machines. In addition, expensive and elaborate packaging is rendered unecessary because the anti-curl coating may be allowed to touch itself without causing the coating to pucker and form dimples and render the photoreceptor useless. Other benefits are realized relating to cost and winding of the photoreceptor roll. Moreover, hardware costs are reduced by, for example, allowing the substitution of stationary rather than rotating roller belt guiding devices. Although stationary cylindrical belt guiding bars are especially abrasive against anti-curl coatings, the improved imaging member of this invention provides a cleaner machine environment and promotes greater machine reliability when used with these types of guide bars. In addition, the improved mechanical life of the anti-curl coating of this invention reduces print defects by markedly extending the cycling resistance to curling of the photoreceptor.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A photoconductive imaging member was prepared by providing a titanium coated polyester (Melinex, available from ICI Inc.) substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2.0 microns.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Larbensabricken Bayer A.G. The resulting mixture was dissolved in 15 percent by weight methylene chloride. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 6 minutes.

An anti-curl coating was prepared by combining 8.82 lb of polycarbonate resin (Makrolon 5705, 8.18 percent by weight solids, available from Bayer AG), 0.09 lb of polyester resin (Vitel PE 100, available from Goodyear Tire and Rubber Co.), and 90.07 lb of methylene chloride in a carboy container to form a coating solution containing 8.9 percent solids. The container was covered tightly and placed on a roll mill for about 24 hours until the polycarbonate and polyester were dissolved in the methylene chloride. The anti-curl coating solution was applied to the rear surface (side opposite the photogenerator layer and charge transport layer) of the photoconductive imaging member by extrusion coating and dried at 135° C. for about 5 minutes to produce a dried film having a thickness of 13.5 micrometers.

Except for the type of anti-curl coating employed, the procedures described in this Example were used to prepare the photoreceptors described in the Examples II through XVI below.

EXAMPLE II

A photoconductive imaging member having two electrically operative layers as descried in Example I was prepared using the same procedures and materials except that an anti-curl coating of this invention was substituted for the anti-curl coating described in Example I. The substituted anti-curl coating was prepared by combining 8.82 lb of polycarbonate resin (Makrolon 5705, available from Bayer AG), 0.09 lb of polyester resin (Vitel PE 100, available from Goodyear Tire and Rubber Co.), and 90.07 lb of methylene chloride in a carboy container. The container was covered tightly and placed on a roll mill for about 24 hours until the polycarbonate and polyester were dissolved in the methylene chloride. The resulting solution was mixed with 0.99 lb (10 percent by weight of the total solids content of the the anti-curl coating) $Cl(CH_2)_3$—Si—$(OCH_3)_3$ (chloropropyltrimethoxysilane) treated crystalline silica particles (available from Petrarch Systems Inc.) in a container with a high shear dispersing rotor (Tekmar Dispax Disperser). The crystalline silica particles had an irregular shape and an average particle size of about 3.2 micrometers. The treated silica particles comprise the reaction product of the hydrolyzed silane and silanol groups on the surface of the silica particles. This container was equipped with a lid and a water jacket to prevent overheating and loss of solvent. The rotor was drive at high speed for 15–30 minutes to disperse the materials. The resulting dispersion was then filtered and applied to a photoconductive imaging member to a form an anti-curl coating containing 10 percent silica using the procedures and materials (other than the anti-curl coating composition) described in Example I. The dried anti-curl coating had a thickness of about 13.5 micrometers.

EXAMPLE III

A photoconductive imaging member having two electrically operative layers as described in Example II was prepared using the same procedures and materials except that 0.495 lb (5 percent by weight of the total solids content of the the anti-curl coating) of $Cl(CH_2)_3$—Si—$(OCH_3)_3$ (chloropropyltrimethoxysilane) treated crystalline silica particles (available from Petrarch Systems Inc.) was substituted for the treated silica described in Example II. The crystalline silica particles had an irregular shape and an average particle size of about 3.2 micrometers. The treated silica particles comprise the reaction product of the hydrolyzed silane and silanol groups on the surface of the silica particles. The resulting dispersion was then filtered and applied to a photoconductive imaging member to a form an anti-curl coating using the procedures and materials (other than the anti-curl coating composition) described in Example I. The dried anti-curl coating contained 5 percent by weight treated silica particles based on the total weight of the dried anti-curl coating and had a thickness of about 13.5 micrometers.

EXAMPLE IV

A photoconductive imaging member having two electrically operative layers as described in Example II was prepared using the same procedures and materials except that 0.25 lb of $Cl(CH_2)_3$—Si—$(OCH_3)_3$ (chloropropyltrimethoxysilane) treated crystalline silica particles (available from Petrach Systems Inc.) was substituted for the treated silica described in Example II. The crystalline silica particles had an irregular shape and an average particle size of about 3.2 micrometers. The treated silica particles comprise the reaction product of the hydrolyzed silane and silanol groups on the surface of the silica particles. Using the procedures and materials (other than the anti-curl coating composition) described in Example I, the resulting dispersion was then filtered and applied to a photoconductive imaging member to a form an anti-curl coating containing 2.5 percent by weight treated silica particles based on the total weight of the dried anti-curl coating. The dried anti-curl coating had a thickness of about 13.5 micrometers.

EXAMPLE V

A photoconductive imaging member having two electrically operative layers as described in Example II was prepared using the same procedures and materials except that 0.99 lb of untreated crystalline silica particles (Malvern 337, available from Malvern Minerals Co.) was substituted for the treated silica described in Example II. The crystalline silica particles had an irregular shape and an average particle size of about 2.8 micrometers. The resulting dispersion was then filtered and applied to a photoconductive imaging member using the procedures and materials (other than the anti-curl coating composition) described in Example I, the resulting dispersion was then filtered and applied to a photoconductive imaging member to form an anti-curl coating containing 10 percent by weight untreated silica particles based on the total weight of the dried anti-curl coating. The dried anti-curl coating had a thickness of about 13.5 micrometers.

EXAMPLE VI

A photoconductive imaging member having two electrically operative layers as described in Example II was prepared using the same procedures and materials except that 0.495 lb of untreated crystalline silica particles (Malvern 337, available from Malvern Minerals Co.) was substituted for the treated silica described in Example II. The crystalline silica particles had an irregular shape and an average particle size of about 2.8 micrometers. The resulting dispersion was then filtered and applied to a photoconductive imaging member using the procedures and materials (other than the anti-curl coating composition) described in Example I, the resulting dispersion was then filtered and applied to a photoconductive imaging member to form an anti-curl coating containing 5 percent by weight untreated silica particles based on the total weight of the dried anti-curl coating. The dried anti-curl coating had a thickness of about 13.5 micrometers.

EXAMPLE VII

A photoconductive imaging member having two electrically operative layers as described in Example II was prepared using the same procedures and materials except that 0.25 lb of untreated crystalline silica particles (Malvern 337, available from Malvern Minerals Co.) was substituted for the treated silica described in Example II. The crystalline silica particles had an irregular shape and an average particle size of about 2.8 micrometers. The resulting dispersion was then filtered and applied to a photoconductive imaging member using the procedures and materials (other than the anti-curl coating composition) described in Example I, the resulting dispersion was then filtered and applied to a photoconductive imaging member to form an anti-curl coating containing 2.5 percent by weight untreated silica particles based on the total weight of the dried anti-curl coating. The dried anti-curl coating had a thickness of about 13.5 micrometers.

EXAMPLE VIII

A photoconductive imaging member having two electrically operative layers as described in Example II was prepared using the same procedures and materials except that 0.99 lb of

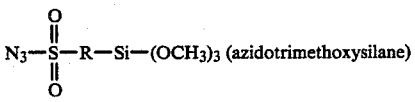

treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member using the procedures and materials (other than the anti-curl coating composition) described in Example I to form an anti-curl coating containing 10 percent by weight treated silica particles based on the total weight of the dried anti-curl coating. The dried anti-curl coating had a thickness of about 13.5 micrometers.

EXAMPLE IX

A photoconductive imaging member having two electrically operative layers as described in Example II was prepared using the same procedures and materials except that 0.495 lb of

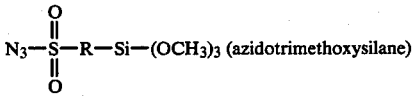

treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member using the procedures and materials (other than the anti-curl coating composition) described in Example I to form an anti-curl coating containing 5 percent by weight treated silica particles based on the total weight of the dried anti-curl coating. The dried anti-curl coating had a thickness of about 13.5 micrometers.

EXAMPLE X

A photoconductive imaging member having two electrically operative layers as described in Example II was prepared using the same procedures and materials except that 0.25 lb of

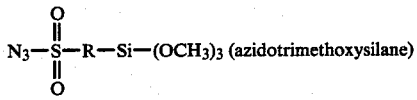

treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member using the procedures and materials (other than the anti-curl coating composition) described in Example I to form an anti-curl coating containing 2.5 percent by weight treated silica particles based on the total weight of the dried anti-curl coating. The dried anti-curl coating had a thickness of about 13.5 micrometers.

EXAMPLE XI

A photoconductive imaging member having two electrically operative layers as described in Example II was prepared using the same procedures and materials except that 0.99 lb of $NH_2(CH_2)_3—Si—(OC_2H_5)_3$ (3 aminopropyltriethoxysilane) treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member using the procedures and materials (other than the anti-curl coating composition) described in Example I to form an anti-curl coating containing 10 percent by weight treated silica particles based on the total weight of the dried anti-curl coating. The dried anti-curl coating had a thickness of about 13.5 micrometers.

EXAMPLE XII

A photoconductive imaging member having two electrically operative layers as described in Example II was prepared using the same procedures and materials except that 0.495 lb of $NH_2(CH_2)_3$—Si—$(OC_2H_5)_3$ (3 aminopropyltriethoxysilane) treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member using the procedures and materials (other than the anti-curl coating composition) described in Example I to form an anti-curl coating containing 5 percent by weight treated silica particles based on the total weight of the dried anti-curl coating. The dried anti-curl coating had a thickness of about 13.5 micrometers.

EXAMPLE XIII

A photoconductive imaging member having two electrically operative layers as described in Example II was prepared using the same procedures and materials except that 0.25 lb of $NH_2(CH_2)_3$—Si—$(OC_2H_5)_3$ (3 aminopropyltriethoxysilane) treated crystalline silica particles was substituted for the treated silica described in Example II. The silica particles (Malvern 337, available from Malvern Minerals Co. in untreated form) had an irregular shape and an average particle size of about 2.8 micrometers. The treated silica particles comprise the reaction product of the hydrolyzed silane and silanol groups on the surface of the silica particles. The resulting dispersion was then filtered and applied to a photoconductive imaging member using the procedures and materials (other than the anti-curl coating composition) described in Example I to form an anti-curl coating containing 2.5 percent by weight treated silica particles based on the total weight of the dried anti-curl coating. The dried anti-curl coating had a thickness of about 13.5 micrometers.

EXAMPLE XIV

A photoconductive imaging member having two electrically operative layers as described in Example II was prepared using the same procedures and materials except that 0.99 lb of untreated amorphous silica particles (Lovel #27, available from PPG Industries) was substituted for the treated silica described in Example II. The untreated amorphous silica particles had a spherical shape and an average particle size of about 300 angstroms, but included aggregates having an average size of about 100 micrometers. The resulting dispersion was then filtered and applied to a photoconductive imaging member using the procedures and materials (other than the anti-curl coating composition) described in Example I to form an anti-curl coating containing 10 percent by weight untreated amorphous silica particles based on the total weight of the dried anti-curl coating. The dried anti-curl coating had a thickness of about 13.5 micrometers.

EXAMPLE XV

A photoconductive imaging member having two electrically operative layers as described in Example II was prepared using the same procedures and materials except that 0.495 lb of untreated amorphous silica particles (Lovel #27, available from PPG Industries) was substituted for the treated silica described in Example II. The untreated amorphous silica particles had a spherical shape and an average particle size of about 300 angstroms, but included aggregates having an average size of about 100 micrometers. The resulting dispersion was then filtered and applied to a photoconductive imaging member using the procedures and materials (other than the anti-curl coating composition) described in Example I to form an anti-curl coating containing 5 percent by weight untreated amorphous silica particles based on the total weight of the dried anti-curl coating. The dried anti-curl coating had a thickness of about 13.5 micrometers.

EXAMPLE XVI

A photoconductive imaging member having two electrically operative layers as described in Example II was prepared using the same procedures and materials except that 0.25 lb of untreated amorphous silica particles (Lovel #27, available from PPG Industries) was substituted for the treated silica described in Example II. The untreated amorphous silica particles had a spherical shape and an average particle size of about 300 angstroms, but included aggregates having an average size of about 100 micrometers. The resulting dispersion was then filtered and applied to a photoconductive imaging member using the procedures and materials (other than the anti-curl coating composition) described in Example I to form an anti-curl coating containing 2.5 percent by weight untreated amorphous silica particles based on the total weight of the dried anti-curl coating. The dried anti-curl coating had a thickness of about 13.5 micrometers.

EXAMPLE XVII

The anti-curl layers of the photoconductive imaging members of Examples I–XVI were tested for Young's Modulus, rupture stress, peel strength, and coefficient of friction. Young's Modulus was determined by cutting a minimum of five 1.27 cm × 10.16 cm imaging member samples, inserting each sample into the jaws of an Instron Tensile Tester using a 5.08 cm gage, and pulling the sample to full scale using a 0.51 mm/min crosshead speed, a 50.8 cm chart speed and a 453.6 gm full scale. The best straight line was drawn using the relationship:

$$E = \sigma/\epsilon$$

$$\text{where } \sigma = \frac{\text{force (453.6 g)}}{\text{sample area}} \text{ and}$$

$$\epsilon = \frac{\Delta l}{l_o} = \frac{\text{change in length at } F = 453.6 \text{ g}}{\text{gage length}}$$

Rupture stress was determined by cutting a minimum of five 1.27 cm×10.16 cm imaging member samples, inserting each sample into the jaws of an Instron Tensile Tester using a 5.08 cm gage, using a 5.1 mm/min crosshead speed, maintaining a 50.8 cm chart speed, and pulling the sample to rupture. Rupture stress was equal to the applied force of rupture divided by the cross-sectional area of the sample.

Peel strength was determined by cuttng a minimum of five 0.5 in×6 in imaging member samples. For each sample, the anti-curl layer was partially stripped from the supporting polyester substrate to about 3.5 in from one end to expose part of the underlying polyester substrate. The exposed surface of the polyester substrate was secured to a 1 in×6 in×0.5 in aluminum backing plate with the aid of two sided adhesive tape and the end of resulting assembly opposite the the end from which the anti-curl layer was not stripped was inserted into the upper jaws of an Instron Tensile Tester. The free end of the partially peeled anti-curl layer was inserted into the lower jaws of the Instron Tensile Tester. The jaws were then activated at a 1 in/min crosshead speed, a 2 in chart speed and a load range of 200 g to peel the sample at least 2 in. The load was plotted versus the peel strength and the peel strength was determined to be the minimum load required for stripping.

The coefficient of friction test was conducted by fastening the photoconductive imaging member to be tested to the flat surface of the bottom of a horizontally sliding 200 gram weight. The weight was dragged in a straight line on a flat horizontal test surface with the outer surface of the anti-curl layer facing downwardly. The weight was moved by a cable which had one end fastened to the weight and the other end threaded around a low friction pulley. The pulley was positioned so that the segment of the cable between the weight and the pulley is parallel to the surface of the flat horizontal test surface. The cable was pulled vertically upward from the pulley by an Instron Tensile Tester. Different materials (see Table I below) were used on the flat horizontal test surface for the different friction tests including stainless steel and the same material used in the charge transport layer.

TABLE I

| Example | Modulus (psi) | Rupture Strain (Percent) | Peel Strength (gm/cm) | Coefficient of Friction: Transport Layer Static | Transport Layer Dynamic | Stainless Steel Static | Stainless Steel Dynamic |
|---|---|---|---|---|---|---|---|
| I (control) | $2.5 \times 10^5$ | 10.3 | 19 | 3.0 | 1.0 | 0.23 | 0.20 |
| II | $2.2 \times 10^5$ | 8.3 | 36 | 0.74 | 0.5 | 0.25 | 0.18 |
| III | $2.7 \times 10^5$ | 8.6 | 45 | 0.87 | 0.6 | 0.24 | 0.20 |
| IV | $3.1 \times 10^5$ | 7.5 | 42 | 0.95 | 0.8 | 0.26 | 0.24 |
| V | $2.6 \times 10^5$ | 6.8 | 54 | 0.54 | 0.53 | 0.21 | 0.20 |
| VI | $2.4 \times 10^5$ | 17.3 | 40 | 0.55 | 0.54 | 0.18 | 0.16 |
| VII | $2.6 \times 10^5$ | 15.5 | 37 | 0.53 | 0.52 | 0.18 | 0.16 |
| VIII | $2.6 \times 10^5$ | 10.0 | 81 | 0.56 | 0.50 | 0.17 | 0.16 |
| IX | $2.4 \times 10^5$ | 10.6 | 125 | 0.55 | 0.53 | 0.16 | 0.15 |
| X | $2.6 \times 10^5$ | 14.0 | 85 | 0.60 | 0.54 | 0.18 | 0.16 |
| XI | $3.1 \times 10^5$ | 30.7 | 56 | 0.57 | 0.57 | 0.18 | 0.17 |
| XII | $2.6 \times 10^5$ | 12.0 | 55 | 0.56 | 0.56 | 0.19 | 0.17 |
| XIII | $2.5 \times 10^5$ | 10.0 | 45 | 0.56 | 0.55 | 0.19 | 0.18 |
| XIV | $2.8 \times 10^5$ | 10.0 | 4.5 | 0.54 | 0.54 | 0.18 | 0.18 |
| XV | $2.6 \times 10^5$ | 9.3 | 13 | 0.55 | 0.54 | 0.17 | 0.16 |
| XVI | $2.2 \times 10^5$ | 11.0 | 46 | 0.57 | 0.54 | 0.19 | 0.17 |

The data in Table I illustrate that the addition of microcrystalline silica to the anti-curl coating maintains the Young's modulus of the anti-curl coating, retains most of or in some cases increases the resistance of the anti-curl coating to rupture strain, improves adhesion of the anti-curl coating to the substrate by at least 90 percent, and markedly reduces the coefficient of contact friction between the anti-curl layer and the transport material as well as stainless steel. while preserving the optical transmission properties of the anti-curl coating.

EXAMPLE XVIII

The photoconductive imaging members of Examples I (control), II, III, IV, VIII, IX, X, XI, XII, XIII<XIV, XV, and XVI were also evaluated for optical transmission properties. A reflectance measurement was performed with an integrating sphere. The specular and diffuse components were collected. Since all samples exhibited nearly identical reflection spectra, the changes in transmission were interpreted as changes in light absorbed in the anti-curl layer itself. This test represents the amount of light that would reach the ground plane/generator layer through the anti-curl layer. The imaging members of Examples II–III and XI–XIII showed no differences in transmission compared to the control. The imaging members of Examples XV, XVI, IX, and X showed little deviation in transmission compared to the control. The imaging members of Examples VIII and XIV showed only a 5 percent decrease in transmission in the visible portion of the spectrum compared to the control.

EXAMPLE XIX

A photoconductive imaging member having two electrically operative layers as described in Example I was prepared using the same procedures and materials except that an anti-curl coating of this invention was substituted for the anti-curl coating described in Example I. The substituted anti-curl coating was prepared by combining 8.82 grams of polycarbonate resin (Makrolon 5705, available from Bayer AG), 0.09 grams of polyester resin (Vitel PE 100, available from Goodyear Tire and Rubber Co.), and 90.07 grams of methylene chloride in a carboy container to form a coating solution containing 8.9 percent solids. The container was covered tightly and placed on a roll mill for about 24 hours until the polycarbonate and polyester were dissolved in the methylene chloride. The resulting solution was mixed with 0.495 grams of 3 amino propyltriethoxysilane treated crystalline silica particles in a container with a high shear dispersing rotor, (Tekmar Dispax Disperser). These coated irregularly shaped crystalline silica particles (Novakup GA-1, available from Malvern Minerals Co.) carried a thin monomolecular reaction product coating in which the bi-functional coupling agent and the silicon atoms on the surface of the crystalline silica particles are chemically bonded to each other through an oxygen atom. The 3 amino propyltriethoxysilane treated crystalline silica particles were classified to obtain the particle size range of between about 0.3 micrometer and 4.9 micrometers prior to mixing. This container was equipped with a lid and a water jacket to prevent overheating and loss of solvent. The rotor was driven at high speed for 15–30 minutes to disperse the materials. The resulting dispersion was then filtered and applied to a photoconductive imaging member to a form an anti-curl coating using the procedures and materials (other than the anti-curl coating composition) described in Example I. The dried anti-curl coating contained 5 percent by weight treated crystalline silica based on the weight of the dried anti-curl coating had a thickness of about 13.5 micrometers.

EXAMPLE XX

A photoconductive imaging member having two electrically operative layers as described in Example I was prepared using the same procedures and materials except that an anti-curl coating of this invention was substituted for the anti-curl coating described in Example I. The substituted anti-curl coating was prepared by combining 8.2 grams of polycarbonate resin (Makrolon 5705, available from Bayer AG), 0.09 grams of polyester resin (Vitel PE 100, available from Goodyear Tire and Rubber Co.), and 90.07 grams of methylene chloride in a carboy container. The container was covered tightly and placed on a roll mill for about 24 hours until the polycarbonate and polyester were dissolved in the methylene chloride. The resulting solution was mixed with 0.75 grams of 3 amino propyltriethoxysilane treated crystalline silica particles having a particle size range of between about 0.3 micrometers and 4.9 micrometers in a container with a high shear dipsersing rotor (Tekmar Dispax Disperser). These coated irregularly shaped crystalline silica particles (Novakup GA-1, available from Malvern Minerals Co.) carried a thin monomolecular reaction product coating in which the bi-functional silane coupling agent and the silicon atoms on the surface of the crystalline silica particles were chemically bonded to each other through an oxygen atom. The 3 amino propyltriethoxysilane treated crystalline silica particles were classified to obtain the particle size range of between about 0.3 micrometer and 4.9 micrometers prior to mixing. This container was equipped with a lid and a water jacket to prevent overheating and loss of solvent. The rotor was driven at high speed for 15–30 minutes to disperse the materials. The resulting dispersion was then filtered and applied to a photoconductive imaging member to a form an anti-curl coating of 7.5 percent by weight silica using the procedures and materials (other than the anti-curl coating composition) described in Example I. The dried anti-curl coating had a thickness of about 13.5 micrometers.

EXAMPLE XXI

A photoconductive imaging member having two electrically operative layers as described in Example I was prepared using the same procedures and materials except that an anti-curl coating of this invention was substituted for the anti-curl coating described in Example I. The substituted anti-curl coating was prepared by combining 8.82 grams of polycarbonate resin (Makrolon 5705, available from Bayer AG), 0.09 grams of polyester resin (Vitel PE 100, available from Goodyear Tire and Rubber Co.), and 90.07 grams of methylene chloride in a carboy container. The container was covered tightly and placed on a roll mill for about 24 hours until the polycarbonate and polyester were dissolved in the methylene chloride. The resulting solution was mixed with 0.99 grams of 3 amino propyltriethoxysilane treated crystalline silica particles having a particle size range of between about 0.3 micrometers and 4.9 micrometers in a container with a high shear dispersing rotor (Tekmar Dispax Disperser). These coated irregularly shaped crystalline silica particles (Novakup GA-1, available from Malvern Minerals Co.) carried a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles were classified to obtain the particle size range of between about 0.3 micrometer and 4.9 micrometers prior to mixing. This container was equipped with a lid and a water jacket to prevent overheating and loss of solvent. The rotor was driven at high speed for 15–30 minutes to disperse the materials. The resulting dispersion was then filtered and applied to a photoconductive imaging member to a form an anti-curl coating of 10 percent by weight silica using the procedures and materials (other than the anti-curl coating composition) described in Example I. The dried anti-curl coating had a thickness of about 13.5 micrometers.

EXAMPLE XXII

The anti-curl layers of the photoconductive imaging members of Examples I and XVIII–XX were tested and compared for coefficient of friction and peel strength. The coefficient of friction test was conducted in the same manner as that described in Example XVII with the bottom of the sliding weight coated with the charge transport layer composition described in Example I. The peel strength test was also conducted in the same manner as that described in Example XVII.

TABLE II

| Example | Coefficient of Friction Static | Coefficient of Friction Dynamic | Peel Strength (gm/cm) |
|---|---|---|---|
| I (control) | 2.83 | 0.91 | 39 |
| XVIII | 0.62 | 0.43 | 80 |
| XIX | 0.61 | 0.43 | 82 |
| XX | 0.62 | 0.43 | 79 |

The data in Table II illustrates that the coefficient of static friction between the anti-curl and the charge transport layer for control Example I was about 356 percent greater than that of Examples XVIII, XIX and XX. Moreover, the adhesion between the anti curl layer and the transport layer was increased by about 100 percent.

EXAMPLE XXIII

The anti-curl coating coatings of Examples I and XIX–XXI were tested for resistance to wear. Testing was effected by means of a dynamic mechanical cycling device in which glass tubes were skidded across the outer surface of the anti-curl coating on each photoconductive imaging member. More specifically, one end of the belt was clamped to a stationary post and the belt looped upward over three horizontal glass tubes and then downwardly over a stationary guide tube through an generally inverted "U" shaped path with the free end of the belt secured to a weight which provided one pound per inch width tension on the belt. The side of the electrophotographic imaging member bearing the anti-curl coating was allowed contact the glass tubes. The glass tubes had a diameter of one inch. Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated, two glass tubes were maintained in sliding contact with the surface of the anti-curl layer as the disks were rotated about the shaft. The axis of each glass tube was positioned about 4 cm from the shaft. The direction of movement of the glass tubes along the anti-curl layer was away from the weighted end of the belt toward the end clamped to the stationary post. Since there were three glass tubes in the test device, each cycle of the disk was equivalent to three machine cycles in which the surface of the anti-curl coatings is in sliding contact with a single stationary support tube during each xerographic cycle. The rotation of the spinning disk was adjusted to provide the equivalent of 11.3 inches per second belt speed. This test simulated the conditions in a high speed electrophotographic duplicator in which a stationary support bar is employed to support the belt. The results of this wear test are described in Table III below.

TABLE III

| Example | After 90,000 Machine Cycles (micrometers) | After 330,000 Machine Cycles (micrometers) |
|---|---|---|
| I (control) | 3 | 10 |
| XVIII | 1.5 | 5 |
| XIX | 0.5 | 2 |
| XX | 0.3 | ≦1 |

The data in Table II illustrates that the addition of crystalline silica particles treated with a bifunctional coupling agent markedly improves the resistance to wear of the anti curl layer. The anti-curl layer of the control example exhibited about 900 percent greater wear than the anti curl layer containing 10 percent by weight treated silica.

EXAMPLE XXIV

Photoconductive imaging members having two electrically operative layers as described in Example XI were prepared using the same procedures and materials except that four bi-functional chemical coupling agent treated crystalline silica particles batches were substituted for the bi-functional chemical coupling agent treated crystalline silica particles described in Example XI. Only the silica particle size range of each of the substituted silica batches differed from the silica employed in Example XI. The particle size range for each of the four different bi-functional chemical coupling agent treated crystalline silica particles used were:

Batch A=0.0–10 micrometers
Batch B=0.0–7.5 micrometers
Batch C=0.0–4.9 micrometers
Batch D=0.0–4.1 micrometers The surface roughness of the exposed surface of the anti-curl coatings were found to increase with an increase in particle size but all were deemed to be acceptable for recycling in electrophotographic imaging devices.

The following examples are proposed formulations and procedures for preparing electrophotographic imaging members utilizing an anti curl backing layer comprising a film forming binder, crystalline particles dispersed in the film forming binder and a reaction product of a bi-functional chemical coupling agent with both the film forming binder and the crystalline particles.

EXAMPLE XXV

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polyarylate resin (Ardel D100, available from Union Carbide Corp.), 0.09 grams of polyester resin (Vitel PE100, available from Goodyear Tire and Rubber Co.), and 90.07 grams of methylene chloride solvent in a carboy container. The container is covered tightly and placed on a roll mill for about 24 hours until the polyarylate and polyester are dissolved in the solvent. The resulting solution can then be mixed with 0.99 gram of 3 aminopropyltriethoxy silane treated crystalline silica particles in a container with a high shear dispersing rotor (Tekmar Dispax Disperser). These coated irregularly shaped crystalline silica particles (Novakup GA-1, available from Malvern Minerals Co.) carry a thin monomolecular reaction product coating in which the bifunctional silane coupling agent and the silicon atoms on the surface of the crystalline silica particles are chemically bonded to each other through an oxygen atom. The 3 aminopropyltriethoxy silane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to form an anti-curl coating using the procedures and materials (other than the anti-curl coating composition) described in Example I. The wet coating can be sufficiently thick to provide a dried anti-curl coating containing 10 percent by weight silica and having a thickness of about 13.5 micrometers.

EXAMPLE XXVI

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polycarbonate resin (Lexan 3250, available from General Electric Co.), 0.09 grams of polyester resin (Vitel PE100, available from Goodyear Tire and Rubber Co.), and 90.07 grams of methylene chloride solvent in a carboy container. The container should be covered tightly and placed on a roll mill for about 24 hours until the polycarbonate and polyester are dissolved in the solvent. The resulting solution can then be mixed with 0.99 gram of 3 aminopropyltriethoxy silane treated crystalline silica particles in a container with a high shear dispersing rotor (Tekmar Dispax Disperser). These coated irregularly shaped crystalline silica particles (Novakup GA-1, available from Malvern Minerals Co.) carry a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to a form an anti-curl coating using the procedures and materials (other than the anti-curl coating composition) described in Example I. The wet coating can be sufficiently thick to provide a dried anti-curl coating containing 10 percent by weight silica and having a thickness of about 13.5 micrometers.

EXAMPLE XXVII

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polyethersulfone resin (Vitrex 300P, available from ICI Inc.), 0.09 gram of polyester resin (Vitel PE100, available from Goodyear Tire and Rubber Co.), and 90.07 grams of methylene chloride solvent in a carboy container. The container is covered tightly and placed on a roll mill for about 24 hours until the polyethersulfone and polyester are dissolved in the solvent. The resulting solution can then be mixed with 0.99 gram of 3 aminopropyltriethoxy silane treated crystalline silica particles in a container with a high shear dispersing rotor (Tekmar Dispax Disperser). These coated irregularly shaped crystalline silica particles (Novakup GA-1, available from Malvern Minerals Co.) carry a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to a form an anti-curl coating using the procedures and materials (other than the anti-curl coating composition) described in Example I. The wet coating can be sufficiently thick to provide a dried anti-curl coating containing 10 percent by weight silica and having a thickness of about 13.5 micrometers.

EXAMPLE XXVIII

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polysulfone resin (Udel P1700, available from Union Carbide Co.), 0.09 gram of polyester resin (Vitel PE100, available from Goodyear Tire and Rubber Co.), and 90.97 grams of methylene chloride solvent in a carboy container. The container is covered tightly and placed on a roll mill for about 24 hours until the polysulfone and polyester are dissolved in the solvent. The resulting solution can then be mixed with 0.99 gram of 3 aminopropyltriethoxy silane treated crystalline silica particles in a container with a high shear dispersing rotor, (Tekmar Dispax Disperser). These coated irregularly shaped crystalline silica particles (Novakup GA-1, available from Malvern Minerals Co.) carry a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to form an anti-curl coating using the procedures and materials (other than the anti-curl coating composition) described in Example I. The wet coating can be sufficiently thick to provide a dried anti-curl coating containing 10 percent by weight silica and having a thickness of about 13.5 micrometers.

EXAMPLE XXIX

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polyetherimide resin (Ultem 1000, available from General Electric Co.), 0.09 gram of polyester resin (Vitel PE100, available from Goodyear Tire and Rubber Co.), and 90.07 grams of methylene chloride solvent in a carboy container. The container is covered tightly and placed on a roll mill for about 24 hours until the polyetherimide and polyester are dissolved in the solvent. The resulting solution can then be mixed with 0.99 gram of 3 aminopropyltriethoxy silane treated crystalline silica particles in a container with a high shear dispersing rotor (Tekmar Dispax Disperser). These coated irregularly shaped crystalline silica particles (Novakup GA-1, available from Malvern Minerals Co.) carry a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to a form an anti-curl coating using the procedures and materials (other than the anti-curl coating composition) described in Example I. The wet coating can be sufficiently thick to provide a dried anti-curl coating containing 10 percent by weight silica and having a thickness of about 13.5 micrometers.

EXAMPLE XXX

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polycarbonate resin (Merlon, available from Mobay Chemical Co.), 0.09 gram of polyester resin (Vitel PE100, available from Goodyear Tire and Rubber Co.), and 90.07 grams of methylene chloride solvent in a carboy container. The container is covered tightly and placed on a roll mill for about 24 hours until the polycarbonate and polyester are dissolved in the solvent. The resulting solution can then be mixed with 0.99 gram of 3 aminopropyltriethoxy silane treated crystalline silica particles in a container with a high shear dispersing rotor (Tekmar Dispax Disperser). These coated irregularly shaped crystalline silica particles (Novakup GA-1, available from Malvern Minerals Co.) carry a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to a form an anti-curl coating using the procedures and materials (other than the anti-curl coating composition) described in Example I. The wet coating can be applied sufficiently thick to provide a dried anti-curl coating containing 10 percent by weight silica and having a thickness of about 13.5 micrometers.

EXAMPLE XXXI

A photoconductive imaging member having two electrically operative layers as described in Example I may be prepared using the same procedures and materials except that the following anti-curl coating of this invention may be substituted for the anti-curl coating described in Example I. The anti-curl coating to be substituted can be prepared by combining 8.82 grams of polystyrene-acrylonitrile resin (SAN 31, available from Monsanto Co.), 0.09 gram of polyester resin (Vitel PE100, available from Goodyear Tire and Rubber Co.), and 90.07 grams of methylene chloride solvent in a carboy container. The container is covered tightly and placed on a roll mill for about 24 hours until the polycarbonate and polyester are dissolved in the solvent. The resulting solution can then be mixed with 0.99 gram of 3 aminopropyltriethoxy silane treated crystalline silica particles in a container with a high shear dispersing rotor (Tekmar Dispax Disperser). These coated irregularly shaped crystalline silica particles (Novakup GA-1, available from Malvern Minerals Co.) carry a thin monomolecular reaction product coating in which the bi-functional silane coupling agent and the silicon atoms on the surface of the crystalline silica particles are chemically bonded to each other through an oxygen atom. The 3 amino propyltriethoxysilane treated crystalline silica particles can be classified to obtain a particle size range of between about 0.3 micrometer and 4.9 micrometers prior to mixing. This container is equipped with a lid and a water jacket to prevent overheating and loss of solvent. The rotor can be driven at high speed for 15–30 minutes to disperse the materials. The resulting dispersion can then be filtered and applied to a photoconductive imaging member to a form an anti-curl coating using the procedures and materials (other than the anti-curl coating composition) described in Example I. The wet coating can be applied sufficiently thick to provide a dried anti-curl coating containing 10 percent by weight silica and having a thickness of about 13.5 micrometers.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. A flexible electrophotographic imaging member comprising a supporting substrate layer having an electrically conductive surface, at least one electrophotographic imaging layer on one side of said substrate layer, and an anti-curl layer on the side of said substrate layer opposite said electrophotographic imaging layer, said anti-curl layer comprising a thermoplastic resin film forming binder having a $T_g$ of at least about 40° C., crystalline particles dispersed in said film forming binder and a reaction product of a bi-functional chemical coupling agent with both said film forming binder and said crystalline particles, said anti-curl layer having a thickness sufficient to substantially balance the total forces of layers on the side of said supporting substrate layer opposite said anti-curl layer, said crystalline particles having metal or metalloid atoms located on the outer surface of said crystalline particles, said crystalline particles and said bi-functional coupling agent being chemically bonded to each other through an oxygen atom by a chemical reaction between reactive hydroxyl groups chemically attached to said metal or metalloid atoms and reactive groups on molecules of said bi-functional coupling agent, and said bi-functional chemical coupling agent and said film forming binder being chemically bonded to each other by a chemical reaction between organo functional reactive groups on molecules of said bi-functional chemical coupling agent and reactive groups on molecules of said film forming binder.

2. A flexible electrophotographic imaging member according to claim 1 wherein said crystalline particles comprise crystalline silica having a particle size less than the thickness of said anti-curl layer.

3. A flexible electrophotographic imaging member according to claim 2 wherein said particle size of said crystalline particles is between about 0.3 micrometer and about 5 micrometers.

4. A flexible electrophotographic imaging member according to claim 1 wherein said bi-functional chemical coupling agent is an amino silane.

5. A flexible electrophotographic imaging member according to claim 1 wherein said bi-functional chemical coupling agent is a hydrolyzed silane having the general formula:

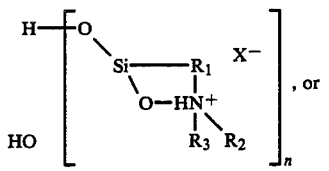

I

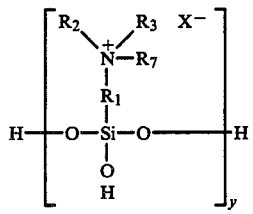

II or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, y is 1, 2, 3 or 4.

6. A flexible electrophotographic imaging member according to claim 1 wherein said bi-functional chemical coupling agent is an aminosilane having the following structural formula:

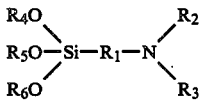

wherein R1 is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino)group, and $R_4$, $R_5$, and $R_6$ are independently selected from a lower alkyl group containing 1 to 4 carbon atoms.

7. A flexible electrophotographic imaging member according to claim 1 wherein said anti-curl layer comprises between about 0.1 percent by weight and about 30 percent by weight crystalline particles based on the total dry weight of said anti-curl layer.

8. A flexible electrophotographic imaging member according to claim 1 wherein said electrophotographic imaging layer comprises a charge generating layer and a charge transport layer.

9. A flexible electrophotographic imaging member according to claim 8 wherein said charge transport layer comprises an organic polymer and an aromatic amine compound having the general formula:

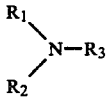

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms, and cycloaliphatic compounds having from 3 to 18 carbon atoms.

10. A flexible electrophotographic imaging member according to claim 1 wherein said crystalline particles have a hardness greater than about 2.5 Mohs.

11. A flexible electrophotographic imaging member according to claim 10 wherein said crystalline particles have a hardness greater than about 4.5 Mohs.

12. A flexible electrophotographic imaging member comprising a supporting substrate layer having an electrically conductive surface, an electrophotographic imaging layer comprising a charge generating layer and a charge transport layer on one side of said substrate layer, and an anti-curl layer on the side of said substrate layer opposite said electrophotographic imaging layer, said anti-curl layer comprising a thermoplastic resin film forming binder having a $T_g$ of at least about 40° C., crystalline silica particles dispersed in said film forming binder and a reaction product of a silane bi-functional chemical coupling agent with both said film forming binder and said crystalline silica particles, said anti-curl layer having a thickness sufficient to substantially balance the total forces of layers on the side of said supporting substrate layer opposite said anti-curl layer, said crystalline silica particles and said bi-functional coupling agent being chemically bonded to each other through an oxygen atom by a chemical reaction between reactive hydroxyl groups chemically attached to silicon atoms located on the outer surface of said crystalline silica particles and reactive groups on molecules of said bi-functional coupling agent, and said bi-functional chemical coupling agent and said film forming binder being chemically bonded to each other by a chemical reaction between organo functional reactive groups on molecules of said bi-functional chemical coupling agent and reactive groups on molecules of said film forming binder selected from the group consisting of COOH, OH, vinyl, amino, amide, epoxide and carbonyl groups.

13. An electrophotographic imaging process comprising providing a flexible electrophotographic imaging member comprising a a supporting substrate layer having an electrically conductive surface, at least one electrophotographic imaging layer on one side of said substrate layer, and an anti-curl layer on the side of said substrate layer opposite said electrophotographic imaging layer, said anti-curl layer comprising a thermoplastic resin film forming binder having a $T_g$ of at least about 40° C., crystalline particles dispersed in said film forming binder and a reaction product of a bi-functional chemical coupling agent with both said film forming binder and said crystalline particles, said anti-curl layer having a thickness sufficient to substantially balance the total forces of layers on the side of said supporting substrate layer opposite said anti-curl layer, said crystalline particles having metal or metalloid atoms located on the outer surface of said crystalline particles, said crystalline particles and said bi-functional coupling agent being chemically bonded to each other through an oxygen atom by a chemical reaction between reactive hydroxyl groups chemically attached to said metal or metalloid atoms and reactive groups on molecules of said bi-functional coupling agent, and said bi-functional chemical coupling agent and said film forming binder being chemically bonded to each other by a chemical reaction between organo functional reactive groups on molecules of said bi-functional chemical coupling agent and reactive groups on molecules of said film forming binder, forming an electrostatic latent image on said imaging surface, forming a toner image on said imaging surface in conformance with said electrostatic latent image and transferring said toner image to a receiving member.

14. An electrophotographic imaging process according to claim 13 comprising uniformly exposing said flexible electrophotographic imaging member to activating magnetic radiation directed through said anti-curl layer after transferring said toner image to said receiving member, said crystalline particles having a refractive index within about 0.5 of that of said film forming binder after said film forming binder is hardened.

15. An electrophotographic imaging process according to claim 13 comprising sliding said anti-curl layer against a stationary support member while forming said electrostatic latent image on said imaging surface, forming said toner image, and transferring said toner image to said receiving member.

* * * * *